United States Patent [19]

Thim

[11] 4,415,120

[45] Nov. 15, 1983

[54] DEVICE FOR SLEEPERS FOR RAILWAY TRACKS

[75] Inventor: Stig Thim, Växjö, Sweden

[73] Assignee: A. Betong AB, Växjö, Sweden

[21] Appl. No.: 228,731

[22] Filed: Jan. 27, 1981

[30] Foreign Application Priority Data

Jan. 30, 1980 [SE] Sweden ..... 8000728

[51] Int. Cl.[3] ..... E01C 9/04

[52] U.S. Cl. ..... 238/8; 238/287; 238/304

[58] Field of Search ..... 238/7, 8, 9, 304, 287

[56] References Cited

U.S. PATENT DOCUMENTS

| | | | |
|---|---|---|---|
| 1,812,707 | 6/1931 | Nagel | 238/8 |
| 2,008,946 | 7/1935 | Cooper | 238/304 |
| 2,076,019 | 4/1937 | Fifield | 238/287 X |
| 4,155,507 | 5/1979 | Chierici et al. | 238/287 |
| 4,236,670 | 12/1980 | Limmergard et al. | 238/8 |
| 4,289,273 | 9/1981 | Schmidt | 238/8 |

FOREIGN PATENT DOCUMENTS

| | | | |
|---|---|---|---|
| 224676 | 12/1962 | Austria | 238/8 |

*Primary Examiner*—Randolph Reese

[57] ABSTRACT

A device for sleepers for railway tracks, which sleepers (6) are adapted to support a number of rails (5) which are situated in a crossover point with an adjacent roadway. The device includes an element (28) with an underside which is adapted to rest, preferably via an intermediate layer (38), against the top of the sleeper (6) which may be planar. A groove (24) is adapted to form a support for the foot (22) of the rail (5). A first heel (33) is on the one side of said groove (24) for the rail foot (22). At the opposite side of said groove (24) in relation to the first heel (33) is another heel (31) with a cylindrical top opposite the underside of the element, the axis of which top extends substantially parallel to the rail (5). Positions (29, 30) are included for clamping devices (25, 26) to secure the rail and the element to the sleeper (6). The first heel (33) is adapted to be placed inside the rail (5) in a railway track and is adapted to form, with its top, a support for the one edge of a slab (9), the other edge of which extends to the other rail (5) belonging to the railway track and to be supported by a corresponding heel on a corresponding element. The other heel (31) is adapted to be situated outside the rail (5) and to form a support for an edge, provided with a corresponding cylindrical recess (32), on another slab (8), the other edge of which extends to the edge of the roadway so that the cylindrical heel forms a pivot bearing for the slab on displacements in height occurring between the edge of the roadway and the sleeper (6).

6 Claims, 4 Drawing Figures

DEVICE FOR SLEEPERS FOR RAILWAY TRACKS

The present invention relates to a device for sleepers for railway tracks.

With the object of facilitating the construction of crossover points for road vehicles over railway tracks, an attempt has been made to use large concrete slabs which, on the one hand fill in the space between the railway rails and on the other hand form lateral regions between the outsides of the rails and the edges of an associated road surface. Since the minimum possible difference in level is desirable between the tops of the rails and the slabs and well defined spaces at the sides of the rails are desirable so as to obtain as unhindered a crossover as possible for road vehicles, an attempt has been made to find a means to provide a positive connection between the slabs and the rails. The idea here was that the slabs should be carried by the same support as the rails and participate in the usual inevitable settlement movements which occur. As a result, unevenness can be avoided and adjustments do not need to be made to the slabs, which are otherwise necessary if they are carried by a bed of gravel for example.

A device of this kind is known from the Norwegian Pat. No. 129 305 as laid open. In the device according to this specification, the rail foot is used to support the slabs by means of intermediate layers of plastics or rubber according to the specification. With such a device, however, the whole arrangement depends largely on the formation of a standard rail foot and no optimum performance can be obtained with regard to mounting, locking characteristics between the various elements, the possibility of adaptation movements under the settling and frost-movement displacements or suitable construction of the necessary tracks for the wheel flanges. It has also been proposed that the actual sleepers which carry the rails should be formed with shaped elements to support the slabs. This can be done with good results in new installations and where sleepers of a formable material such as concrete or metal are in any case preferred. On the other hand, this arrangement is unsuitable for use with existing track installations with which it would be necessary to replace the sleepers, or where wooden sleepers are preferred, for example for reasons of cost, which are not suitable for construction with shaped elements to support the slabs.

The object of the present invention is to provide a device which renders possible the provision of a positive connection for slabs at crossover points for road vehicles on a railway track without its being necessary to alter or replace existing sleepers.

Another object of the invention is to provide a device of said kind which provides a support for the slabs with exceptional characteristics from several points of view such as mounting and load-bearing conditions.

The objects of the invention are achieved by constructing the device with the characteristics given below.

The device at a crossing between road and railway is shown on the accompanying drawings as an example of an embodiment of the invention.

Figure 1:
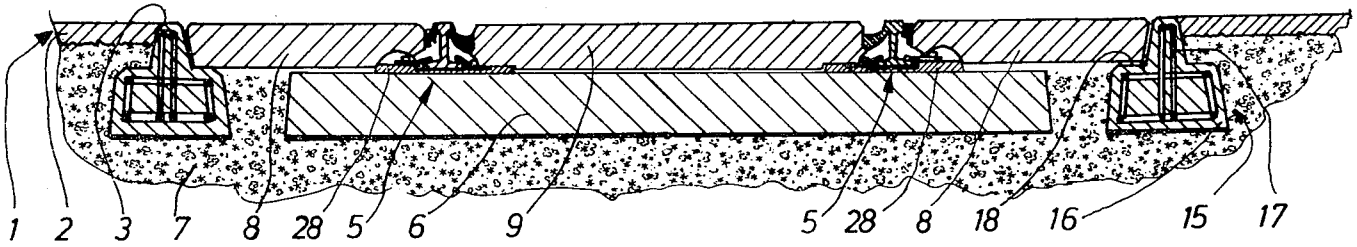
FIG. 1 shows a section through the device extending in the longitudinal direction of the road.
Figure 3:
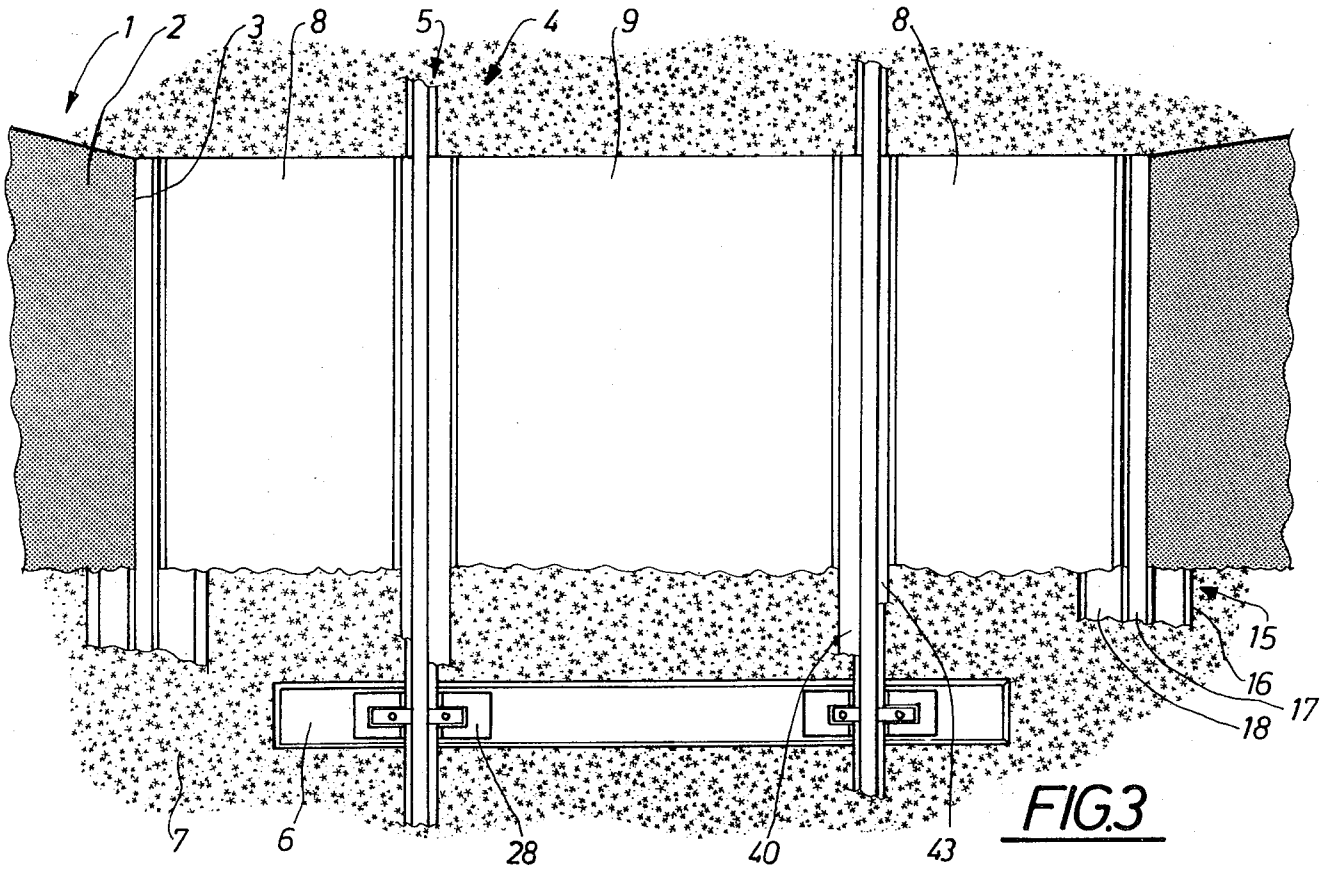
FIG. 3 shows a part of a crossing in a view from above.

According to FIGS. 1 and 3, a roadway 1, here shown with a surface 2 of asphalt for example, comprises an interruption in the surface with terminal edges 3 for a crossing railway track 4. The railway track 4 is shown as a single track with two rails 5 which are carried by sleepers 6 of normal construction, thus with a substantially plane top. Thus the sleepers 6 may be the conventional wooden sleepers. Both the surface 2 of the roadway 1 and the sleepers 6 of the railway track 4 are carried by a support which does not move with frost, so-called ballast 7.

Figure 2:
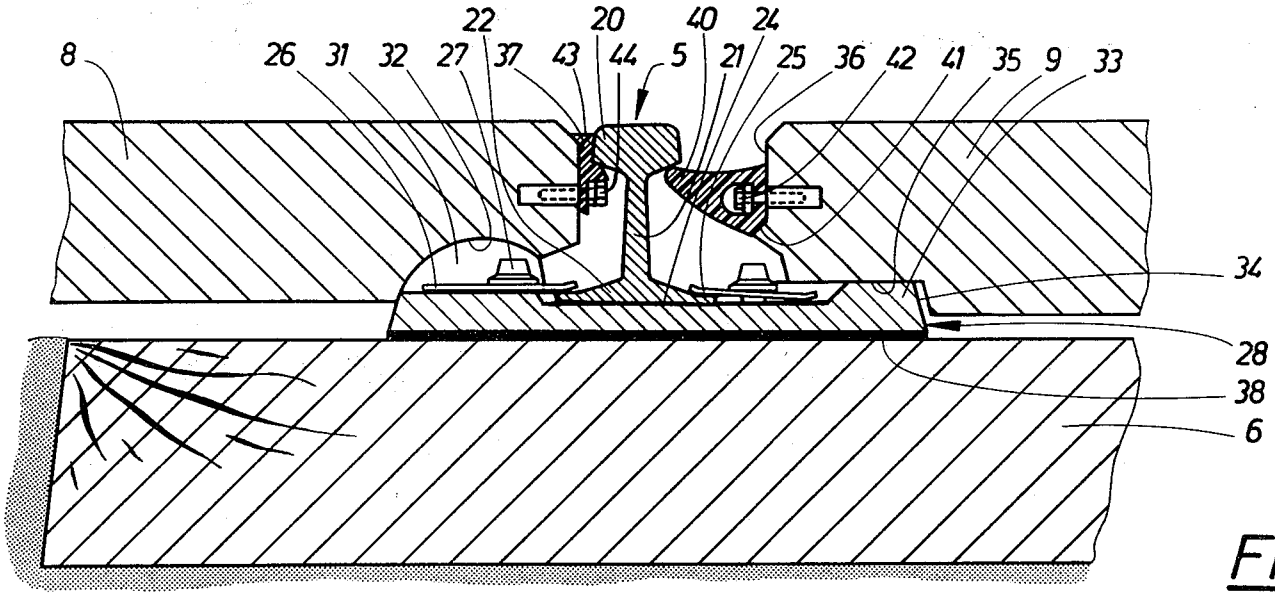
FIG. 2 is a part of the section in FIG. 1, shown on a larger scale.

As can be seen from FIG. 2 in particular, the rail 5 comprises, in the usual manner, a head 20 on the top of which the wheel of the railway vehicle is intended to run, a web 21 and a foot 22.

For the connection of the parts of the roadway 1, three slabs of concrete extend between the edges 3 calculated in the longitudinal direction of the roadway, two slabs hereinafter called lateral slabs 8 at the outside of the two rails 5 and one slab between the rails which is hereinafter called the center slab 9. The slabs 8 and 9 respectively are referred to below as each being a single slab but they may also be a row of slabs in the longitudinal direction of the railway track. In this case they are divided up into sections in the longitudinal direction of the railway track 4 for manufacturing, transport and strength reasons, thus forming rows the number of which is adapted to the prevailing width of the roadway 1.

The slabs may appropriately have a considerable size and should be so wide in the transverse direction of the railway track that they extend without interruption between the edge of the roadway and the rail or between the rails, but even in the longitudinal direction they preferably have such dimensions that they correspond, for example, to half the intended width of the roadway or even the whole width with narrower roads. With greater road widths, however, the slabs can be divided into two or more sections, as stated, each of which nevertheless has a considerable length, preferably of the order of magnitude of 6 meters.

According to the invention, supporting elements 28 are provided to support the rails 5, the lateral slabs 8 and the center plate 9, on the sleepers 6. There is a supporting element for each rail on each sleeper 6. The supporting element is made of a strong material such as reinforced plastics, stiff rubber or steel.

Figure 4:
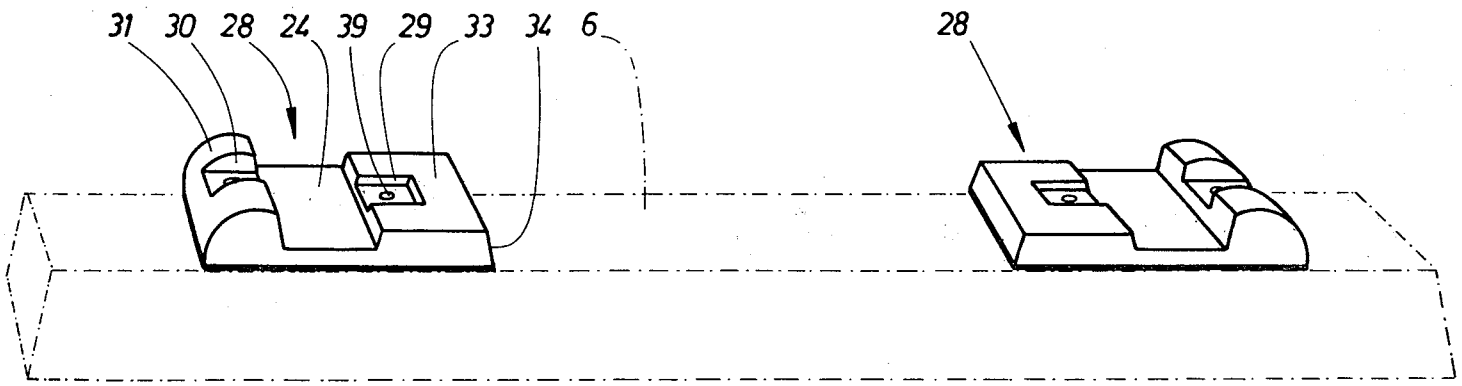
FIG. 4 shows the device in perspective.

The rail is supported by the supporting element 28 in that the foot 22 rests in a groove 24 in the supporting element. If the supporting element 28 is made of a somewhat resilient material, for example plastics or hard rubber, as preferably intended, it can support the rail directly and no intermediate layer, such as occurs with concrete sleepers, is needed. To secure the rail and the supporting element, a plurality of holders 25 and 26 of spring steel are provided which are secured to the sleepers by means of rail screws 27 or the like. According to FIG. 4, grooves 29 and 30 respectively are cut out of the supporting element for the holders 25 and 26.

In order to support the edge of the lateral slab 8 adjacent to the rail, a semicircular projection 31 is provided on the supporting element and fits an arcuate recess 32 at the under side of the lateral slab.

At the other end of the supporting element in relation to the end where the arcuate projection 31 is provided there is provided a heel 33 with a terminating edge 34. In the center slab, at both edges thereof, there is provided a recess 35 the bottom of which forms a support for the heel 33 and the inward-facing lateral edge of which forms a guide for the end edge 34.

Through the supporting element 28, therefore, the slabs 8 and 9 are allowed to move both vertically and sideways in relation to the rail and follow this even if the sleepers should move as a result of frost movements or other movements in the support 7. In addition, the sleepers are enabled to move downwards when loaded by a train for example. These characteristics are thus brought about without any intervention needing to be made in the sleepers which, as stated, may be of conventional construction. As an aid to vertical and sideways movement of the slabs, well defined spaces are formed at the side of the rails, an inner space 36 and an outer space 37.

The supporting element 28 rests in turn on the sleepers 6 via an intermediate layer of rubber 38. The supporting element is secured to the sleepers in a specific position by means of rail screws 27 which extend through holes 39 in the supporting element in question.

The respective outer edges of the lateral slabs 8 are adapted to be supported by two supporting strips 15 of reinforced concrete, comprising a foot 16, the width of which is sufficiently great to form a suitable supporting surface with respect to the support 7, and a strip-shaped head 17 which extends upwards to the same height as the road surface 2 and forms a terminal support for this. Between the head 17 and the foot 16, an edge 18 is formed which is adapted to support the outer edge of the slab 8 in question.

The space 36 is intended to leave room for the flanges on the wheels of the rail vehicle and must permit these flanges to penetrate down to a certain depth. Contrary to this requirement is the desire that the space should be kept free of dirt, clay and other material. In order to satisfy the requirement of free accessibility for the wheel flanges in the space 36 and at the same time to avoid the depositing of unwanted material, the space is provided with a resilient sealing strip 40, preferably of rubber. The sealing strip 40 is secured close to a projection 41 on the slab 9 by means of screws 42 for example.

The purpose of the space 37 is to leave the rail 5 and the slab 8 free clearance for movement, on the shocks and vibrations which occur with traffic, and movements caused by differences in settling. It is nevertheless desirable that the space 37 should also be sealed so that dirt cannot penetrate into it. Such penetration could actually lead to the ballast being contaminated and becoming movable with frost with frost removal problems as a consequence. To seal the space 37, a sealing strip 43 of rubber is secured to the respective slab 8 for example with screws 44. The sealing strip 41 does not, however, need to execute any downward movement and therefore has the form of an element clamped between the sides of the rail and of the slab.

When the crossing is constructed it is presupposed that the railway track is laid with the associated road. The supporting strips 15 are deposited in the connecting edge 3 of the roadway. The sleepers should now be provided with the supporting elements 28. The former rail spikes must first be removed and the rails lifted somewhat so that the supporting elements can be inserted under the rails. Then securing is effected by means of the holders 26 and 25, which are fixed by means of the rail screw 27 as a result of which both the rails and the supporting elements are secured in their specific position. After this, the slabs 8 and 9 with the sealing strips 40, 43 mounted, can be deposited by means of a crane on the base formed by the supporting elements 28 and the supporting strips 15. No adjustment is necessary because of the positive connection which is formed by the recesses 31 and the heels 33.

The form of embodiment has been shown as relating to a crossing with a single track. Adaptation to crossings with a plurality of tracks can easily be effected, however.

In practice, movements in the parts of crossings cannot be avoided. These result partly through settling, accelerated by road and rail traffic over the crossing, and because of frost movements. With the device according to the invention, however, the slabs 8 and 9 forming the roadway in the crossing substantially follow the sleepers 6. As can be seen, the slab 9 is entirely supported by the sleepers 6 at the supporting elements and therefore follows the movements of the rails completely, as a result of which the plane of the slab which is at the same height as the runway of the rail head 20, always retains this position so that no difference in height occurs between these surfaces which would be inconvenient for the road traffic. The slabs 8 are also supported, at their edge adjacent to the rail 5, by the supporting element through the cylindrical surfaces 13, 14. The outer edges, on the other hand, are supported by the supports 15 connected to the road surface 2. This means that the slab 8 is always connected to the top of the rail at its edge adjacent to this and at the same time is at the same height as the road surface 2 regardless of whether the road surface and the sleepers move differently, which often occurs. On such different movements, the slab 8 can pivot about the cylindrical surfaces 13, 14 so that no breaking movements occur, while at the same time its lower surface, at the outer edge, can execute a tilting movement with respect to the surface 18 on the support 15. The lateral movements of the slab 8 against the vertical edge adjacent to the rail, which occur on pivoting of the slab about the cylindrical surfaces 13, 14, are taken up by the resilient sealing strip 41.

The claims defining the invention are as follows:

1. A device for an arrangement at a crossing between a road and railroad tracks, the arrangement being of the type having a row of sleepers adapted to support the rails of the track, the sleepers being substantially perpendicular to the rails, outer slabs positioned between the rails and the road, an inner slab positioned between the rails, said slabs having top surfaces substantially level with the top surfaces of the rails, said outer slabs having inner edges positioned proximate to the rails and outer edges positioned proximate to the road, a pair of elongated support strips positioned adjacent to the road and adapted to support the outer edges of the outer slabs, and first and second clamping devices for holding down the foot of each rail to said sleepers, said device comprising:

a unitary support element including a substantially planer underside adapted to rest upon the topside of each sleeper, said sleeper having a substantially planer topside, a groove formed in said element, said groove being adapted to support said foot of said each rail, said element having an inner portion and an outer portion, said inner portion being on the side of the groove toward the other rail and said outer portion being on the side of the groove toward the road, a first heel positioned on said inner portion of said groove, a second heel positioned on the outer side of said groove, said second heel having a partially cylindrical top surface the axis of which extends substantially parallel to said rail, said first heel having a first section adapted to receive said first clamping device, said clamping device being adapted to hold down one side of said foot of said rail of said element, said second heel having a second section adapted to receive said second clamping device, said second clamping device being adapted to hold down the other side of said foot of said rail to said element and to secured said element to said sleeper, said first heel being adapted to support one edge of said inner slab, said second heel being adapted to support the inner edge of said outer slab, said inner edge forming a partially cylindrical recess adapted to correspond with said partially cylindrical top surface of said second heel, whereby said partially cylindrical top surface of said element acts as a pivot for said outer slab during displacement in height between the edge of the road and said sleeper, said support element being made of a resilient material.

2. A device according to claim 1, wherein said element is substantially a rectangular prism having a length, a width, and a height, said first heel being positioned at one portion of said length, said groove being positioned transverse to said length across said width, and said second heel being positioned at the other end of said length, said partially cylindrical top surface projecting above said height.

3. A device according to claim 2, wherein said first heel forms a first groove coextensive with said first section adapted to receive said clamping device; and said second heel forms a second groove coextensive with said second section adapted to receive said second clamping device.

4. A device according to claim 3, wherein said second groove extends lengthwise through said second heel.

5. A device according to claim 4, wherein first and second vertical holes are formed by said element at said first and second grooves and further including first and second bolts respectfully extending through said clamping device into said first and second holes respectfully into said sleeper, whereby said first and second clamping devices are secured to said element and said element is secured to said sleeper.

6. A device according to claim 1, wherein said resilient material is hard rubber.

* * * * *